United States Patent [19]

Lissau

[11] 4,304,457

[45] Dec. 8, 1981

[54] ELECTRICAL CONNECTOR

[75] Inventor: Frederic Lissau, Chicago, Ill.

[73] Assignee: Sloan Valve Company, Franklin Park, Ill.

[21] Appl. No.: 972,827

[22] Filed: Dec. 26, 1978

Related U.S. Application Data

[63] Continuation-in-part of Ser. No. 864,448, Dec. 27, 1977, abandoned.

[51] Int. Cl.[3] ..... H01R 13/11

[52] U.S. Cl. ..... 339/256 R; 339/192 R

[58] Field of Search ..... 339/256–259, 339/272 R, 192

[56] References Cited

U.S. PATENT DOCUMENTS

| | | | |
|---|---|---|---|
| 2,701,350 | 1/1955 | Soreng | 339/256 SP |
| 2,711,524 | 6/1955 | Beaver | 339/256 R |
| 3,122,407 | 2/1964 | Cowe | 339/217 R |
| 3,178,671 | 4/1965 | Mastis | 339/272 R |
| 3,763,460 | 10/1973 | Hatschek et al. | 339/258 R |
| 4,002,400 | 1/1977 | Evans | 339/258 R |

FOREIGN PATENT DOCUMENTS

| | | | |
|---|---|---|---|
| 734112 | 4/1943 | Fed. Rep. of Germany | 339/256 R |

*Primary Examiner*—Neil Abrams

*Attorney, Agent, or Firm*—Kinzer, Plyer, Dorn & McEachran

[57] ABSTRACT

An electrical connector assembly which includes a plug having contact sockets which are removably locked into place within a plug insert, each socket including a convoluted spring member having three spaced convolutions with the middle convolution projecting a greater distance into the interior of the socket than the convolutions on either side. The convolutions are adapted for spring-like contact with an inserted male contact pin with the middle convolution providing a generally centrally located force on such pin.

3 Claims, 14 Drawing Figures

Fig.1.
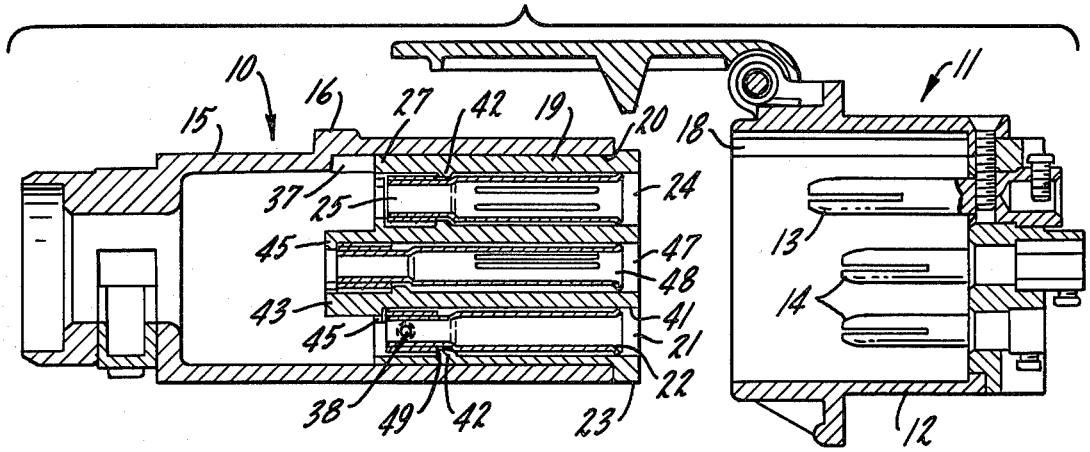
Fig.2.
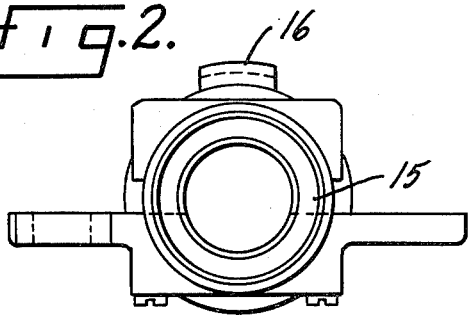
Fig.5.
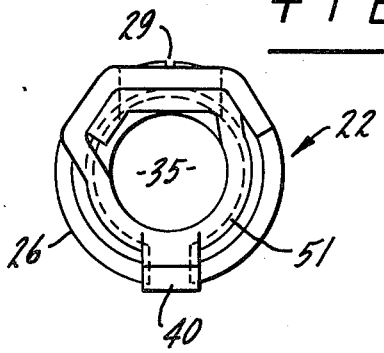
Fig.3.
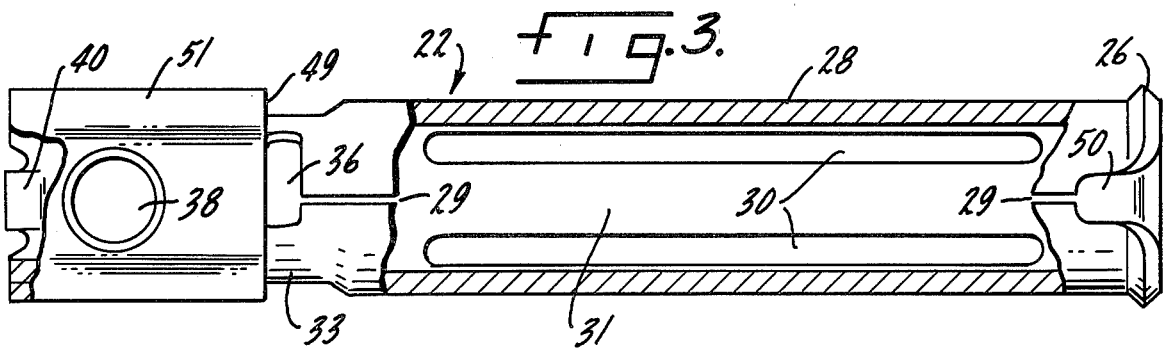
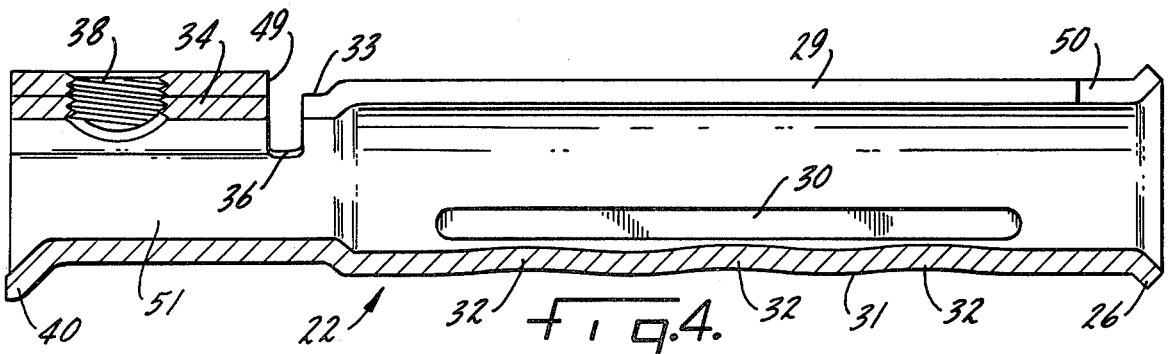
Fig.4.

Fig. 6.
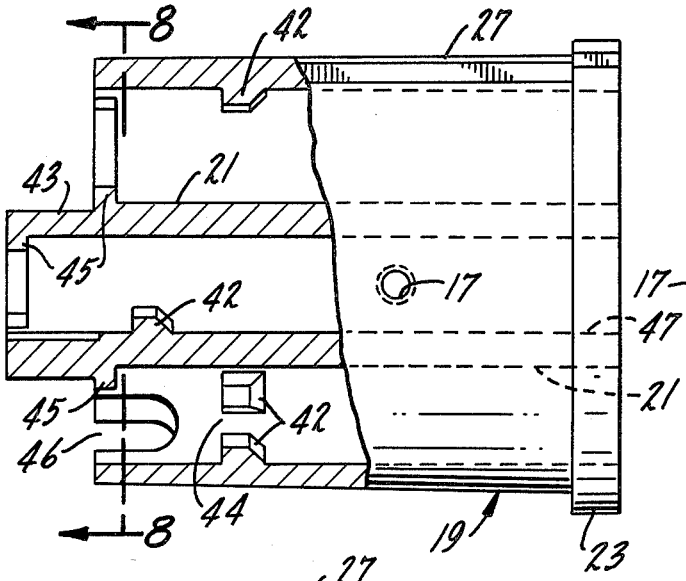
Fig. 7.
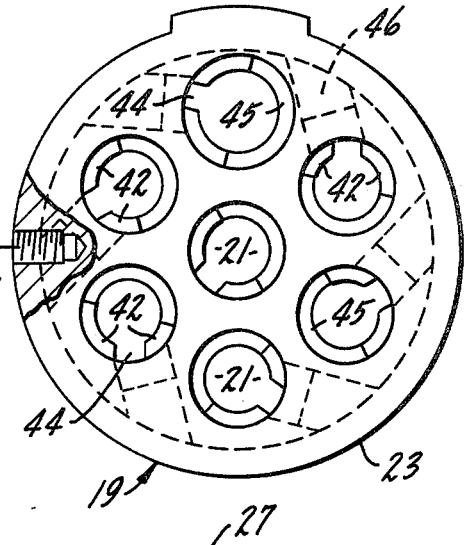
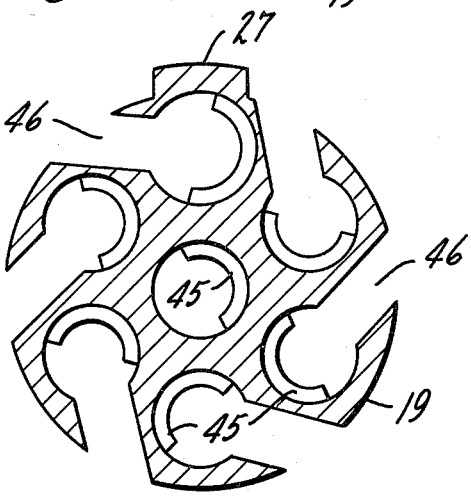
Fig. 8.
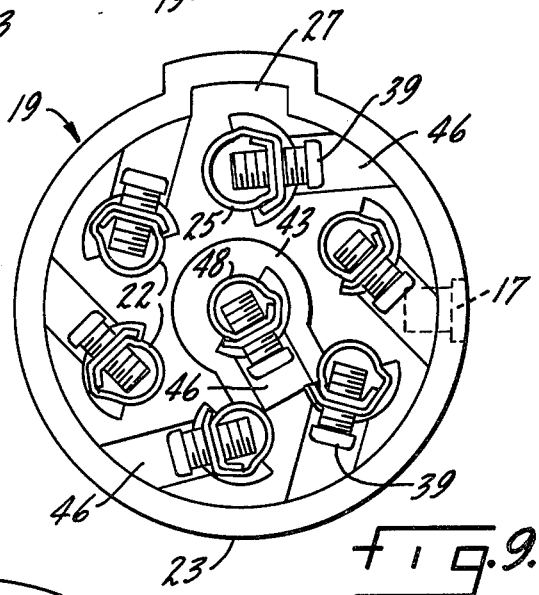
Fig. 9.
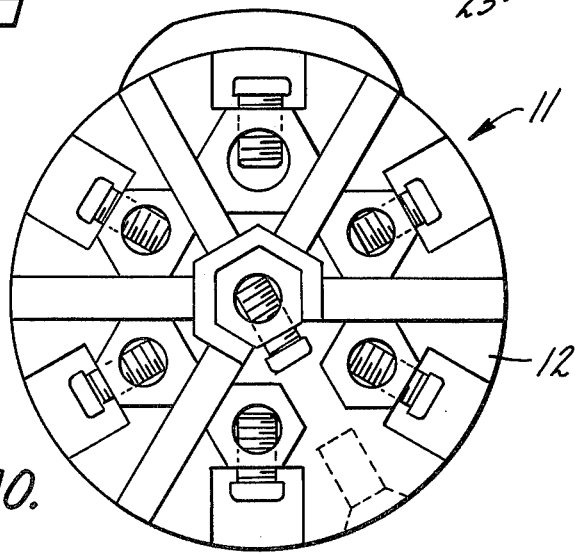
Fig. 10.

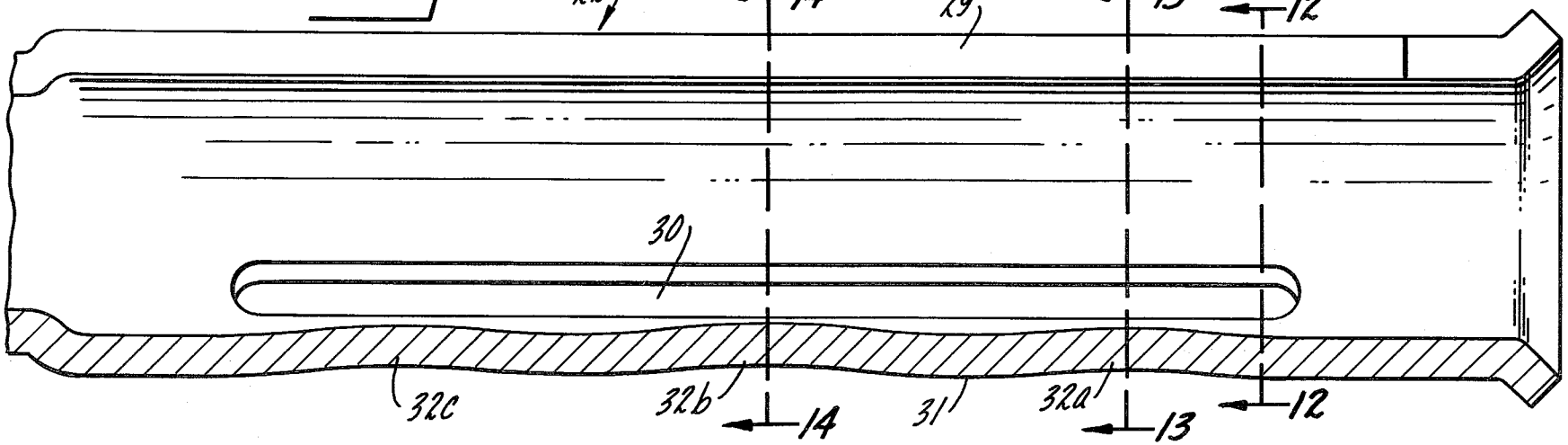
FIG. 11.
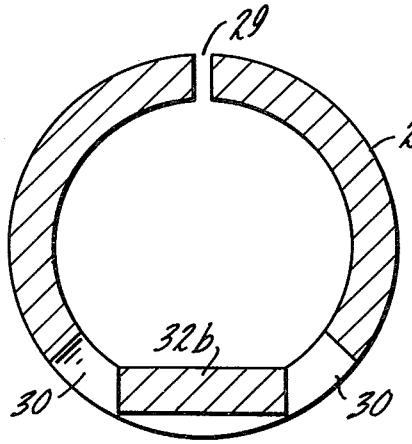
FIG. 12.
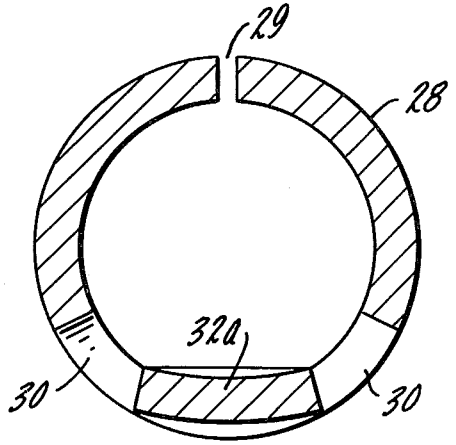
FIG. 13.
FIG. 14.

ELECTRICAL CONNECTOR

This is a continuation-in-part of my copending application Ser. No. 864,448, filed Dec. 27, 1977 now abandoned.

SUMMARY OF THE INVENTION

The present invention relates to electrical connector assemblies particularly adapted for use in tractor trailer combinations.

A primary purpose of this invention is to provide an electrical connector plug which has contact sockets which may be removably locked in place.

Another purpose is an electrical connector plug which has contact sockets of increased strength.

Another purpose is a contact socket having an integral spring member for efficiently holding an inserted pin.

Other objects will appear in the ensuing specification, drawings and claims.

BRIEF DESCRIPTION OF THE DRAWINGS

The invention is illustrated diagrammatically in the following drawings wherein:

FIG. 1 is a section through the plug and receptacle,

FIG. 2 is an end view of the plug,

FIG. 3 is a partial side view of a female contact pin,

FIG. 4 is a sectional side view of the contact pin,

FIG. 5 is an end view of the contact pin,

FIG. 6 is a cutaway view of the plug insert, without contact pins,

FIG. 7 is a front view of the insert, without the contact pins,

FIG. 8 is a section along plane 8—8 of FIG. 6,

FIG. 9 is a rear view of the insert with the contact pins in place,

FIG. 10 is an end view of the receptacle,

FIG. 11 is an enlarged axial section through a portion of the female socket pin, FIG. 12 is a section along plane 12—12 of FIG. 11, FIG. 13 is a section along plane 13—13 of FIG. 11, and FIG. 14 is a section along plane 14—14 of FIG. 11.

DESCRIPTION OF THE PREFERRED EMBODIMENT

The connector plug is indicated generally at 10 and the receptacle is indicated generally at 11 in FIG. 1. The two components of the connector assembly are generally utilized in forming an electrical connection between the tractor and trailer of a tractor-trailer combination. The particular construction of the connector assembly lends itself to such application, although the invention should not be so limited.

The connector receptacle 11 is of a conventional type having a housing 12 and a plurality, for example seven, male contact pins 13 and 14. For details of the connector assembly, reference is made to U.S. patent application Ser. No. 801,098.

Turning to the plug 10, there is plug housing 15, generally cylindrical in form and having an exterior axially extending key 16 which fits within a mating groove 18 in the interior of receptacle housing 11.

An insert 19 is positioned in open end 20 of the plug and is generally cylindrical in form. An axially extending key 27 on the outer wall of insert 19 fits within interior keyway 37 in plug housing 15 providing proper alignment of the insert. Insert 19 has a rim 23 which abuts against housing 15, and as seen in FIG. 6, a threaded hole 17 is provided to secure the insert within the housing. The insert has a plurality, for example six axially extending passages 21, within which are mounted the female contact pins or sockets 22 for receiving male contact pins 14. A larger axial passage 24 and mating socket 25 are provided so that insertion of large male contact pin 13 will insure proper electrical grounding.

Sockets 22 may be formed by folding a section of electrically conductive metal upon itself. As seen in FIGS. 3 and 4, a flared portion 26 appears at one end of socket 22 aiding the insertion of the male pins. Adjacent to flared portion 26 is pin engaging portion 28 with a small gap 29 axially extending the entire length of portions 26 and 28, which gap is formed as the side edges of the socket metal meet upon folding. A spring 31, integral with the socket, and attached thereto at opposite ends, is formed by cutaway areas 30.

A plurality, for example three, convolutions 32 are formed in spring member 31, thereby increasing its resilience. Upon insertion of a pin 14 into the socket 22, the spring member convolutions will force the pin to a highly efficient electrical contacting position within the interior surfaces of socket 22 and will firmly hold the pin within the socket. Details of the convolutions are indicated in FIGS. 11–14. There are three convolutions indicated at **32*a*, 32*b* and 32*c*. The middle convolution 32*b* projects a greater distance toward the axis of the socket, for example by one-third, than do adjacent convolutions 32*a* and 32*c*. As the male pin is inserted and convolution 32*a* is first contacted, the spring element 31 bends away from its axis. To obtain a strong spring force, convolution 32*b*** projects a greater distance toward the axis. If it were not for the differential in the projecting distances of the convolutions, the inserting male pin would push the spring element outwardly to the point that the middle and third convolutions would not be as effective in forcing the male pin toward the opposite side of the spring member. In addition, having the greater projection in the middle convolution results in a more centrally located force on the male pin so that good contact results, without tilting of the male pin. It is particularly important that the male pin be in firm and extensive contact with the female socket to provide a stable electrical path. This is brought about by the described convolutions.

It is important that there be only a single spring element and that it be fixed to the body at its opposite ends. In this way socket 22 does not stretch when the male pin is inserted. If the socket were stretched the compressive forces at the fixed ends of the spring element would be substantial which would lead to fatigue and ultimate failure. By using multiple convolutions, the compressive forces are changed to bending forces along the spring element itself, substantially eliminating the problem of metal fatigue which would be present if convolutions were not used. In addition, multiple convolutions provide a more uniform spring rate.

FIGS. 12–14 illustrate the cross section of the socket and spring at an area of no spring deformity (FIG. 12); spring deformity at the first convolution (FIG. 13); and spring deformity at the greatest convolution (FIG. 14). Note that at center convolution **32*b*** that the spring provides an essentially flat bearing surface for the male contact pin.

The other end of socket 22 is provided with a wire receiving portion 51. As best seen in FIG. 5, the socket metal is folded over to an overlapping position resulting in an irregular outer shape and opening 35 for the reception of the electrical wires (not shown). Transverse slot 36, in a reduced diameter throat portion 33, is necessary to aid the folding and overlapping of the socket metal. Of particular importance is that slot 36 is no larger than necessary to accomplish the overlapping fold. The irregular shape of portion 51 allows the use of a minimal size slot 36, and thereby only slightly reduces the socket's strength from what it would be without the slot. The overlapping section or thicker portion 34 is provided with threaded hole 38 and screw 39 to secure an electrical wire within socket 22. Opposite hole 38 appears tab 40.

Sockets 22 are inserted through front openings 41 of passages 21 in plug insert 19. Each socket may be pushed inwardly until it contacts a pair of projections 42 extending inwardly from the interior wall of passages 21. As seen in FIGS. 6 and 7, projections 42 are positioned so that the space between them forms passage 44. Before the socket can be inserted further, it is necessary that tab 40 on the socket exterior be aligned with passage 44. After alignment, socket 22 may be fully inserted in passage 21 to abut against semicircular projection or stop 45 formed on the rear edge of passage 21. Socket 22 is then rotated a sufficient angle so that tap 40 no longer is in alignment with passage 44. Socket 22 will be locked into place by the cooperation of shoulder 49 and projections 42 preventing movement in one direction and the cooperation of stop 45 and the opposing face, opposite tab 40, preventing movement in the other direction. When necessary, socket 22 may easily be removed by simply rotating it to align tab 40 with passage 44 and then pushing or pulling the socket out of passage 21.

Adjacent to the rear of each passage 21, there appears a traverse recess 46 allowing access to threaded hole 38 so that screw 39 may be inserted to secure the wire in socket 22 as shown in FIG. 9. Tab 40 will provide mechanical support under the screw during assembly of the wire. It is noted that due to the central position of passage 47, the plug insert has an extended portion 43 provided along with recess 46 to enable a wire securing screw 39 to be attached to the centrally located socket 48. Due to the increased length of center passage 47, its socket 48 is increased a corresponding length.

It is pointed out that whenever screw thread hole 38 is aligned with recess 46, the socket shoulder will abut projection 42 and tab 40 will not be in alignment with passage 44. Therefore, when hole 38 is aligned with recess 46 the socket will be locked in place and screw 39 will prevent vehicle vibrations from causing sockets 22 to rotate to a position where they could be accidentally pulled out.

Thus, it can be seen that the invention provides a reliable method for removably locking female contact pins of the socket type. Locking is accomplished by inserting socket 22 until passage 44 is met; aligning the passage and tab 40; further insertion of the socket to the rear passage stop 45; and then rotation of the socket to allow attachment of wire locking screw 39. Removal is accomplished by simply reversing the above procedure. It is noted that rotation of the socket may be accomplished by use of the tip of any suitable screwdriver or by use of any tool which may fit within the socket flange recess 50.

Spring 31 and its convolutions 32 are particularly advantageous in assuring proper electrical contact between the sockets and inserted pins and in securing the pins within the sockets.

Whereas the preferred form of the invention has been shown and described herein, it should be realized that there may be many modifications, substitutions and alterations thereto.

The embodiments of the invention in which an exclusive property or privilege is claimed are defined as follows:

1. In an electrical contact terminal of the female socket type of mounting in a connector plug, said socket having a cylindrical elongated shape and a flared front end portion for insertion of a male contact pin, said socket being split along a major portion of its length from the front end portion to a transverse slot formed adjacent the rear end portion, a convoluted spring member integral with said socket and attached thereto at its opposite ends, said spring member having three spaced convolutions with said middle convolution projecting a greater distance into the interior of said socket than said convolution nearest said flared front end portion, the convolution furthest from said flared front end portion extending a distance into the interior of said socket approximately the same as that of the convolution nearest said flared front end portion, said convolutions being adapted for spring-like contact with an inserted male contact pin, wherein the middle convolution projecting further than the other two convolutions provides a generally centrally located force on an inserted male contact pin without tilting of the pin, each one of said convolutions forming a distinct convexly-shaped projection extending into said socket interior and located to engage said male pin.

2. The contact terminal socket as claimed in claim 1 in which the rear end portion is provided with a key.

3. The contact terminal socket as claimed in claim 1 in which the rear end portion of said socket is formed of the material of said socket folded upon itself said rear end portion opposite the screw opening having a locking key.

* * * * *